US008967110B2

(12) United States Patent
Buehler et al.

(10) Patent No.: US 8,967,110 B2
(45) Date of Patent: Mar. 3, 2015

(54) ENGINE FRONT COVER WITH ROTATIONAL SUPPORT INSERT

(71) Applicant: GM Global Technology Operations LLC, Detroit, MI (US)

(72) Inventors: Charles K. Buehler, Lansing, MI (US); David R. Staley, Flushing, MI (US); Thomas A. Spix, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/678,758

(22) Filed: Nov. 16, 2012

(65) Prior Publication Data

US 2014/0137833 A1 May 22, 2014

(51) Int. Cl.
*F02B 77/00* (2006.01)
*F02F 7/00* (2006.01)

(52) U.S. Cl.
CPC ..... *F02F 7/00* (2013.01)
USPC ..... 123/195 C; 123/195 R; 123/90.38

(58) Field of Classification Search
USPC ..... 123/195 C, 195 R, 195 A, 90.38, 198 E
See application file for complete search history.

(56) References Cited

U.S. PATENT DOCUMENTS

| | | | | |
|---|---|---|---|---|
| 5,083,537 | A * | 1/1992 | Onofrio et al. | 123/195 R |
| 6,478,004 | B1 * | 11/2002 | Deng et al. | 123/195 C |
| 7,389,760 | B2 * | 6/2008 | Fogolini | 123/195 C |
| 7,610,893 | B2 * | 11/2009 | Waters et al. | 123/195 C |
| 7,814,880 | B2 * | 10/2010 | Waters et al. | 123/195 C |
| 2005/0199203 | A1 * | 9/2005 | Stein | 123/90.38 |
| 2007/0261661 | A1 * | 11/2007 | Fogolini | 123/198 E |
| 2009/0217900 | A1 * | 9/2009 | Salameh | 123/195 |
| 2009/0261661 | A1 * | 10/2009 | Finneran | 307/141.8 |
| 2011/0180963 | A1 * | 7/2011 | Kuno et al. | 264/279 |

FOREIGN PATENT DOCUMENTS

EP 399912 A * 11/1990

* cited by examiner

*Primary Examiner* — Noah Kamen
*Assistant Examiner* — Long T Tran
(74) *Attorney, Agent, or Firm* — Harness, Dickey & Pierce, P.L.C.

(57) ABSTRACT

An engine front cover assembly includes a plastic engine cover. A metal insert is secured within the plastic engine cover and defines a bore configured to receive a rotating engine component. A seal is located in a seal seat defined within the bore of the metal insert and configured to sealingly engage the rotating engine component. The metal insert is overmolded within the plastic engine cover and serves as a datum point to properly locate the seal relative to the rotating engine component.

12 Claims, 5 Drawing Sheets

ENGINE FRONT COVER WITH ROTATIONAL SUPPORT INSERT

FIELD

The present disclosure relates to an engine assembly, and more particularly, to an engine front or rear cover made from plastic and having a molded-in metal insert defining a bore for receiving a rotating engine component.

BACKGROUND

This section provides background information related to the present disclosure which is not necessarily prior art.

Currently, engine covers (front or rear) are produced from aluminum castings or steel stampings. The aluminum castings provide a flexibility in design, but the cost and mass of aluminum are significant and it is desirable to use a significantly lower mass component.

SUMMARY

The present disclosure is directed to an engine front cover assembly including a plastic engine cover. A metal insert is secured within the plastic engine cover and defines a bore configured to receive a rotating engine component. A seal is located in a seal seat defined within the bore of the metal insert and configured to sealingly engage the rotating engine component. The metal insert can include a radially extending flange portion defining reinforcing ribs that are overmolded by plastic reinforcing ribs of the plastic engine cover. The flange portion can be a mesh or textured surface to provide enhanced surface area contact between the plastic front cover and the metal insert.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Figure 1:
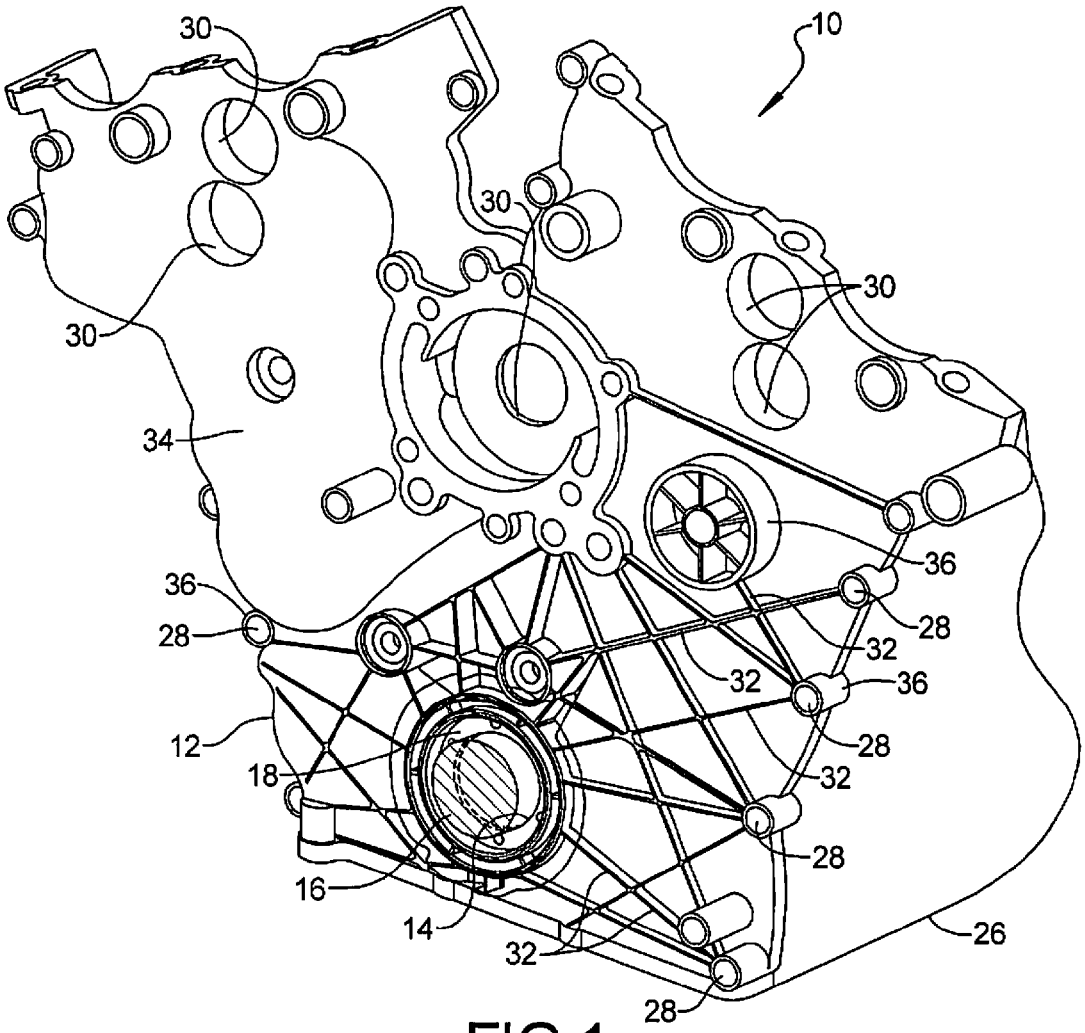
FIG. 1 is a perspective view of an engine front cover assembly according to the principles of the present disclosure.

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

With reference to FIGS. 1-5, the plastic engine front cover assembly 10 according to the principles of the present disclosure will now be described. The engine front cover assembly 10 includes a plastic engine cover 12 defining an aperture 14 configured to receive a rotating engine component 16 such as a crankshaft, camshaft, or idler shaft, therethrough. A metal insert 18 is secured within the plastic engine cover and defines a seal bore 20 configured to receive the rotating engine component 16. A seal 22 is located within a seal seat 24 defined within the seal bore 20 of the metal insert 18 and configured to sealingly engage the rotating engine component 16.

Even though the plastic materials have performance characteristics approximately equivalent to aluminum, obtaining tolerances around the crank seal is very difficult. To resolve this, the crankshaft center is set as the datum point and the metal insert 18 with the shaft seal seat 24 is overmolded at the centered location creating a final dimensionally correct part that is lighter in weight than conventional steel or aluminum engine covers. Should there be additional adjustments, the metal insert 18 can be machined to requirements.

Figure 2:
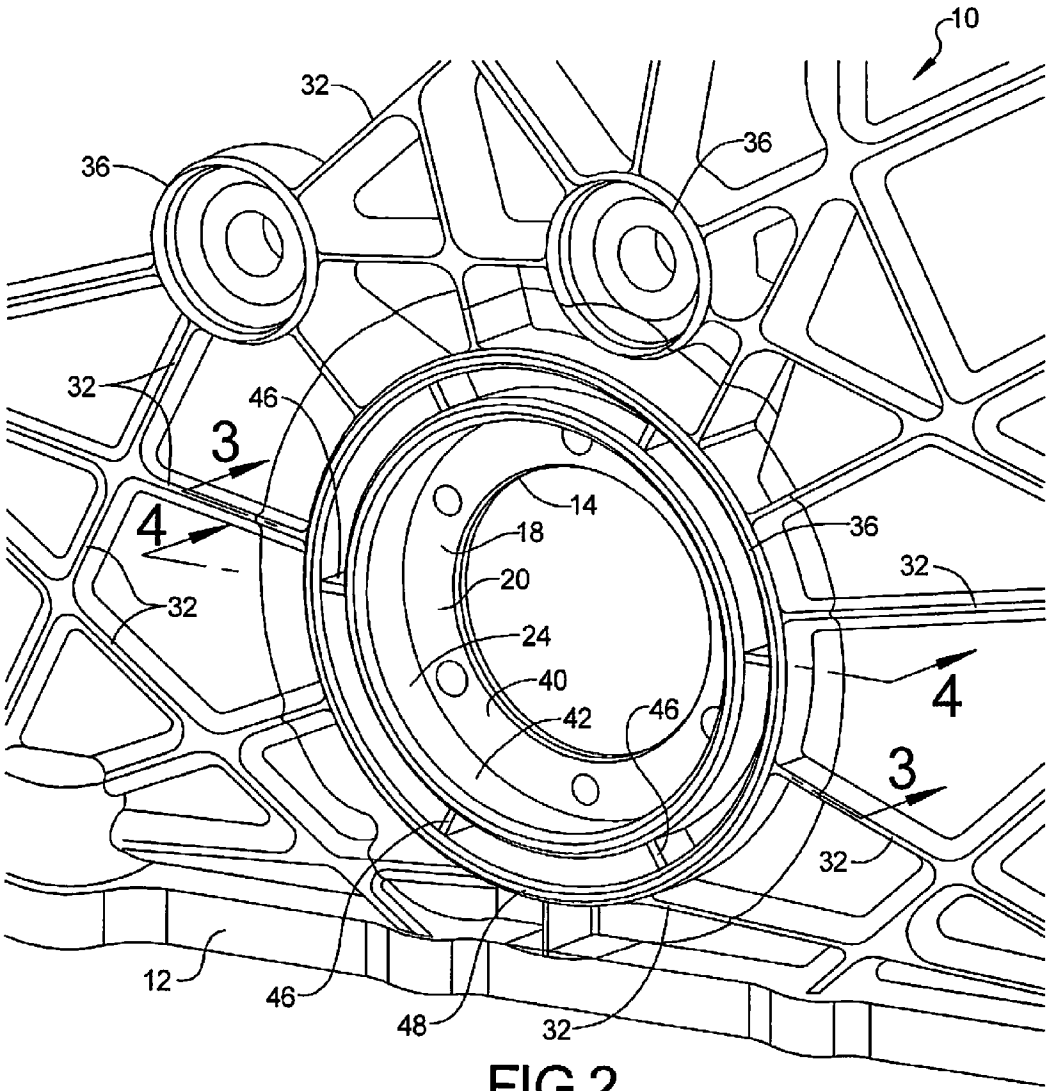
FIG. 2 is a close-up perspective view of the engine front cover illustrating the metal insert overmolded within the plastic front cover.

The metal insert 18 can be overmolded within the plastic engine cover 12. The plastic engine cover 12 is configured to fit over an end of an engine block 26 and can include a plurality of mounting apertures 28 for mounting the cover 12 to the engine block 26 and/or other components of the engine assembly such as the cylinder heads, and intake manifolds and oil pans, if desired. The plastic engine cover 12 can also include additional apertures 30 to receive additional pulley hubs/tensions and cam shafts. The plastic engine cover 12 can also include a plurality of intersecting reinforcing ribs 32 on at least one face 34 thereof. The reinforcing ribs 32 can intersect with annular ribs 36 that can surround the mounting apertures 28 as well as the aperture 14 and additional apertures 30, as shown in FIGS. 1 and 2. It is noted that in FIG. 1 only a portion of the detail of the reinforcing ribs 32 and 36 are shown for simplicity, while it should be understood that the reinforcing ribs 32, 36 are intended to extend along the entire surface of the cover 10.

Figure 3:
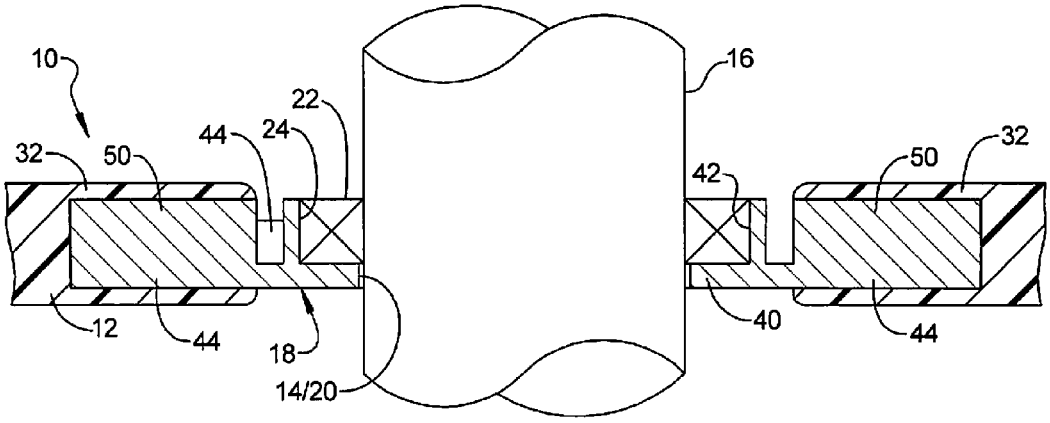
FIG. 3 is a cross-sectional view of the engine front cover taken along line 3-3 of FIG. 2.
Figure 4:
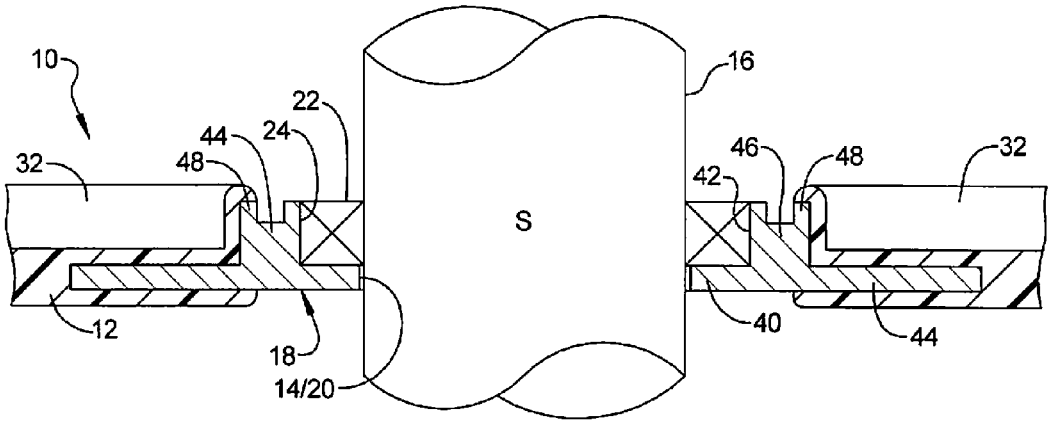
FIG. 4 is a cross-sectional view of the engine front cover taken along line 4-4 of FIG. 2 and further illustrating an optional mesh pattern of the flange portion of the metal insert.
Figure 5A:
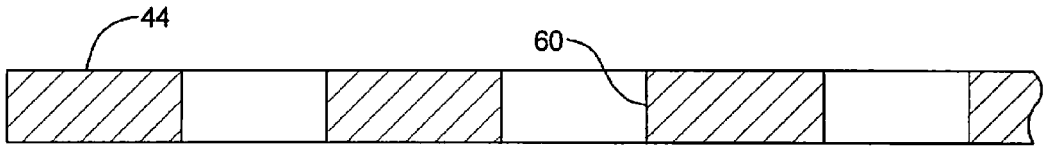
FIG. 5*a*-5*c* illustrate alternative surface patterns of the flange portion of the metal insert.
Figure 5B:
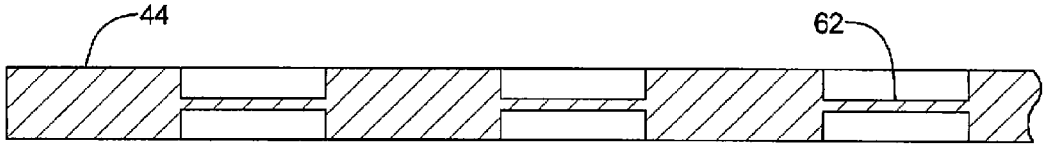
Figure 5C:
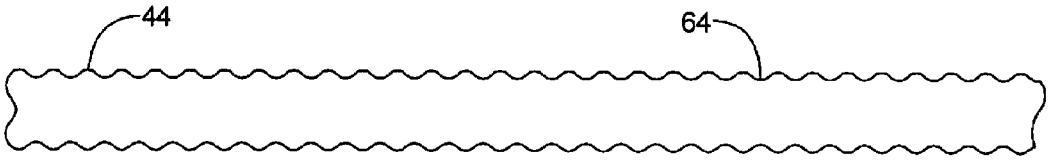

With reference to FIGS. 2-4, the metal insert 18 can include a generally planar wall portion 40 defining the circular bore 20 therein. An annular wall portion 42 extends axially from the planar wall portion 40 and is coaxial with the bore 20 for defining the seal seat 24, wherein the seal 22 seats against the annular wall portion 42 and the planar wall portion 40. A plurality of radially extending reinforcing ribs 46 can extend radially outward from the annular wall portion 42 in a spoke-like fashion and terminate at a second annular wall portion 48. Additional reinforcing ribs 50 can extend radially outward from the second annular wall portion 48 and can be overmolded by the reinforcing ribs 32 of the plastic engine cover 12, as best shown in FIG. 3. A section 44 of the planar wall portion 40 can optionally be provided with a mesh-like portion defining holes 60 (FIG. 5A) or waffle-type recesses 62 (FIG. 5B) or other surface irregularities 64 (FIG. 5C) that are overmolded by the plastic engine cover 12 and therefore provide additional surface area contact between the metal insert 18 and the plastic engine cover 12.

Figure 6:
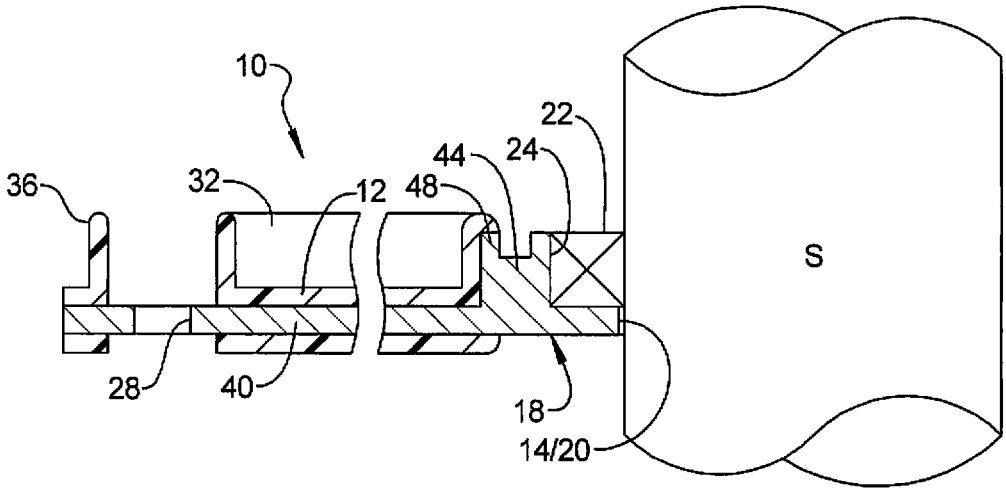
FIG. 6 is a cross-sectional view of the engine cover including mounting holes incorporated into the metal insert.

With reference to FIG. 6, the planar wall portion 40 of the metal insert 18 can extend laterally or vertically to encompass mounting apertures 28 on opposites sides of the seal bore 20 to help to stabilize the position of the seal 22 in the as-built condition as the plastic expands and contracts with temperature variations. As the cover heats up, the metal insert 18 holds the seal 22 in its proper position with the perimeter bolt bosses 28. According to one embodiment, the metal insert can extend a sufficient distance to encompass at least a pair of bolt bosses 28 on opposite sides of the seal bore 20.

The additional reinforcing ribs 50 of the metal insert 18 can have a height of 30-70% of the final overmolded rib height. The ribs 50 of the metal insert 18 can have a thickness of 30-60% of the final overmolded rib thickness, and more preferably 40-50% of the final overmolded rib thickness. The length of the reinforcing ribs can be at least 25 mm and up to approximately 75 mm long. The thickness of the planar section 44A of the flange portion 44 can be between 0.75 and 2 mm. The size of the holes in the mesh or the recesses in the waffle-like pattern can be from 0.5 to 3.2 mm, and more preferably, 1-2 mm in diameter. The insert 18 can be made from brass, aluminum, steel, magnesium, pressed metal, or other materials. The plastic front engine cover 12 can be made from high performance thermoplastic or thermoset resins enhanced with fiberglass or other filler types at levels of from 30-60%. Also, the material should be able to withstand continuous temperatures of 130° C.

What is claimed is;

1. An engine cover assembly comprising:

a plastic engine cover defining an aperture configured to receive a rotatable engine component;

a metal insert including an annular body defining a bore configured to receive the rotatable engine component and having a planar portion extending radially from an outer perimeter of the annular body, the metal insert defining a monolithic body including the annular body and the planar portion overmolded within the plastic engine cover, wherein the monolithic body of the metal insert includes at least a pair of mounting apertures therein for securing the metal insert directly to an engine structure; and a seal located in a seal seat defined within the bore of the metal insert and configured to sealingly engage the rotatable engine component.

2. The engine cover assembly of claim 1, wherein the rotatable engine component includes a crankshaft.

3. The engine cover assembly of claim 1, wherein the planar portion of the metal insert includes a web structure of reinforcing ribs.

4. The engine cover assembly of claim 3, wherein the plastic engine cover is injection molded around the planar portion of the metal insert.

5. The engine cover assembly of claim 4, wherein the plastic engine cover defines ribs at locations corresponding to the reinforcing ribs of the metal insert.

6. The engine cover assembly of claim 1, wherein the plastic front cover is injection molded around at least a portion of the metal insert.

7. The engine cover assembly of claim 1, wherein the pair of mounting apertures are on opposite sides of the bore.

8. An engine assembly comprising:

an engine block supporting a rotatable crankshaft;

a plastic engine cover defining an aperture configured to receive the crankshaft;

a metal insert over-molded within the plastic engine cover and defining a bore configured to receive the crankshaft, the metal insert defining a monolithic body including an annular body defining the bore and having a planar portion extending radially from an outer perimeter of the annular body wherein the planar portion of the metal insert includes a web structure of reinforcing ribs extending therefrom with ends of the reinforcing ribs connected to the annular body of the metal insert; and a seal located in a seal seat defined within the bore of the metal insert and configured to sealingly engage the crankshaft.

9. The engine assembly of claim 8 , wherein the plastic engine cover is injection molded around the metal insert.

10. The engine assembly of claim 9, wherein the plastic engine cover defines ribs at locations corresponding to the reinforcing ribs of the metal insert.

11. The engine assembly of claim 8, wherein the metal insert includes at least a pair of mounting apertures therein for securing the metal insert directly to the engine block.

12. The engine assembly of claim 11, wherein the pair of mounting apertures are on opposite sides of the bore.

* * * * *